US009822669B2

(12) United States Patent
Wiebe et al.

(10) Patent No.: US 9,822,669 B2
(45) Date of Patent: Nov. 21, 2017

(54) TURBINE ASSEMBLY WITH DETACHABLE STRUTS

(71) Applicant: Siemens Energy, Inc., Orlando, FL (US)

(72) Inventors: David J. Wiebe, Orlando, FL (US); Jerome H. Katy, Palm Beach Gardens, FL (US); Richard Seleski, Palm Beach Gardens, FL (US); Benjamin G. Hettinger, Jupiter, FL (US); Adam Wallace, Jupiter, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 0 days.

(21) Appl. No.: 15/322,244

(22) PCT Filed: Jul. 18, 2014

(86) PCT No.: PCT/US2014/047179
§ 371 (c)(1),
(2) Date: Dec. 27, 2016

(87) PCT Pub. No.: WO2016/010554
PCT Pub. Date: Jan. 21, 2016

(65) Prior Publication Data

US 2017/0130608 A1 May 11, 2017

(51) Int. Cl.
*F04D 29/52* (2006.01)
*F01D 25/28* (2006.01)
(Continued)

(52) U.S. Cl.
CPC ..... *F01D 25/28* (2013.01); *F01D 9/065* (2013.01); *F01D 25/162* (2013.01);
(Continued)

(58) Field of Classification Search
CPC ..... F01D 25/28; F01D 9/065; F01D 25/162
See application file for complete search history.

(56) References Cited

U.S. PATENT DOCUMENTS 4,979,872 A 12/1990 Myers et al.
4,987,736 A 1/1991 Ciokajlo et al.
(Continued)

FOREIGN PATENT DOCUMENTS

CN 103557035 A 2/2014
CN 104919140 A 9/2015
(Continued)

OTHER PUBLICATIONS

PCT International Search Report and Written Opinion dated Apr. 1, 2015 corresponding to PCT Application No. PCT/US2014/047179 filed Jul. 18, 2014.

*Primary Examiner* — Igor Kershteyn
*Assistant Examiner* — Kayla McCaffrey

(57) ABSTRACT

A turbine assembly having an outer casing (36), an inner structural ring (38), and an annular gas path (42) defined between outer and inner flow path walls (44, 46) for conducting a gas flow through the turbine assembly. A plurality of structural struts (52) are spaced apart in a circumferential direction, each strut (52) including a strut body (52*a*) extending in a radial direction for supporting the inner structural ring (38) to the outer casing (36). A first strut end (64) at a radially outer end of the strut body (52*a*) is detachably attached to the outer casing (36) with a first fastener structure (68) engaging the outer casing (36), and a second strut end (66) at a radially inner end of the strut body (52*a*) is detachably attached to the inner structural ring (38) with a second fastener structure (70) engaging the inner structural ring (38).

13 Claims, 4 Drawing Sheets

(51) Int. Cl.
*F01D 9/06* (2006.01)
*F01D 25/16* (2006.01)

(52) U.S. Cl.
CPC ..... *F05D 2240/14* (2013.01); *F05D 2260/30* (2013.01); *F05D 2260/31* (2013.01)

(56) References Cited

U.S. PATENT DOCUMENTS

| | | | | |
|---|---|---|---|---|
| 4,989,406 | A | 2/1991 | Vdoviak et al. | |
| 5,292,227 | A | 3/1994 | Czachor et al. | |
| 5,312,227 | A | 5/1994 | Grateau et al. | |
| 5,609,467 | A | 3/1997 | Lenhart et al. | |
| 7,383,686 | B2 | 6/2008 | Aycock et al. | |
| 2010/0303608 | A1 | 12/2010 | Kataoka et al. | |
| 2010/0307165 | A1 | 12/2010 | Wong et al. | |
| 2010/0322759 | A1 | 12/2010 | Tanioka | |
| 2011/0286851 | A1 | 11/2011 | Benkler et al. | |
| 2012/0027604 | A1 | 2/2012 | McDonald et al. | |
| 2013/0011242 | A1* | 1/2013 | Beeck ..... | F01D 25/28 415/142 |
| 2013/0052006 | A1 | 2/2013 | Petty | |
| 2013/0115079 | A1 | 5/2013 | Farah et al. | |

FOREIGN PATENT DOCUMENTS

| | | | |
|---|---|---|---|
| GB | 1076367 | A | 7/1967 |
| GB | 2084261 | A | 4/1982 |
| WO | 2014051686 | A1 | 4/2014 |

* cited by examiner

FIG. 1
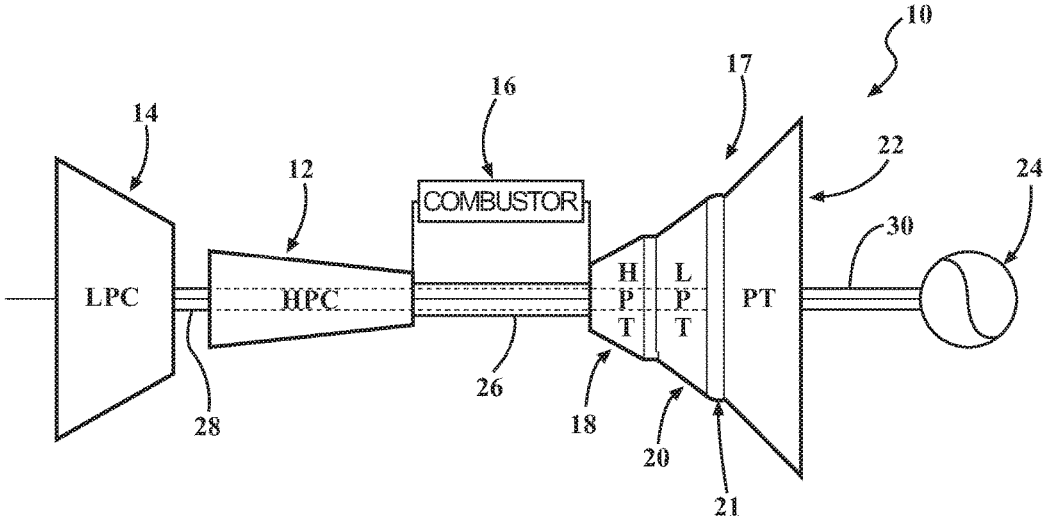
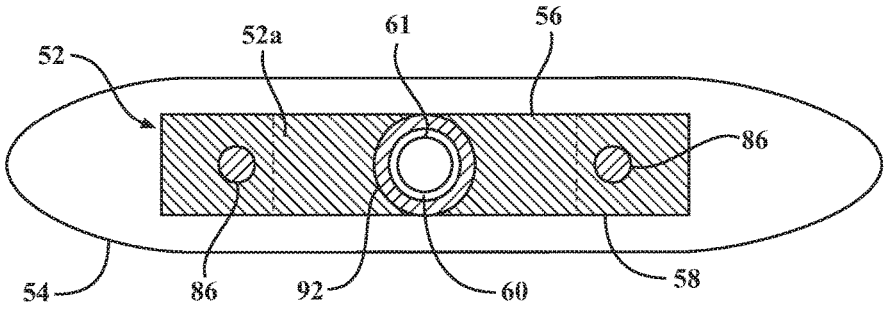
FIG. 3

TURBINE ASSEMBLY WITH DETACHABLE STRUTS

FIELD OF THE INVENTION

The present invention relates to gas turbine engines and, more particularly, to structure supporting a radially inner ring structure relative to a radially outer casing of the engine.

BACKGROUND OF THE INVENTION

In gas turbine engines, a radially inner structure, such as a bearing housing, may be supported relative to an outer casing of the engine by radially extending struts. The struts may be welded to the outer casing and extend radially through an outer duct structure defining an outer boundary for a hot working gas flow path, pass through the flow path, and extend through an inner duct structure defining a boundary for the flow path to a welded attachment location on the bearing housing. Since such a structure is formed as a welded structure, repairs typically necessitate cutting out parts of the structure and welding in new structure.

Alternatively, the bearing housing may be supported relative to the outer casing by tie rods extending radially from the outer casing to the bearing housing to radially locate the bearing housing. While such a radial rod support structure may provide good load transfer in the radial direction, such a structure typically must be maintained in radial tension and does not provide substantial support against axial loads applied to the bearing housing.

SUMMARY OF THE INVENTION

In accordance with an aspect of the invention, a turbine assembly is provided in a turbine engine, the turbine assembly having an outer casing, an inner structural ring, and an annular gas path defined between outer and inner flow path walls for conducting a gas flow through the turbine assembly in an axial direction, and further comprising: a plurality of structural struts spaced apart in a circumferential direction, each strut including a strut body extending in a radial direction between and supporting the inner structural ring to the outer casing; a fairing surrounding each of the struts in an area extending between the outer and inner flow path walls; a first strut end at a radially outer end of the strut body and detachably attached to the outer casing with a first fastener structure engaging the outer casing; and a second strut end at a radially inner end of the strut body and detachably attached to the inner structural ring with a second fastener structure engaging the inner structural ring.

The outer casing may include a strut aperture defined by an aperture surface and the first strut end may include a boss comprising an outer boss surface engaged against the aperture surface, and the first strut end can further include an outer flange extending perpendicular to the radial direction and extending over and positioned in contact with a portion of the outer casing.

The first fastener structure can include bolts that pass through the outer flange and that are engaged in holes in the outer casing.

The strut body can define a diametric dimension that is less than a diametric dimension of the outer boss surface parallel to the diametric dimension of the strut body, such that the strut body is spaced from the aperture surface at a location where the strut body is radially adjacent to the aperture surface.

The second strut end can include an inner flange extending outward from the strut body and perpendicular to the radial direction of the strut, the inner flange can include a planar surface facing radially inward and engaging a planar surface of the inner ring structure that faces radially outward.

The second fastener structure can include bolts passing through the inner flange and engaged in holes in the inner structural ring.

A spigot can be provided protruding from the inward facing planar surface and engaging within a recess in the outward facing planar surface to locate the second strut end at a predetermined location with reference to directions perpendicular to the radial direction.

The inner flange can be positioned in a T-shaped slot formed in the inner structural ring.

The inner structural ring can comprise first and second ring portions coupled together to sandwich the inner flange between the first and second ring portions.

The first and second ring portions can be coupled at a joint overlapping the inner flange.

The second fastener structure can comprise fasteners extending through and retaining the first and second ring portions in engagement with each other.

The T-shaped slot can include radially outward extending, inward angled sides and the inner flange can have a dove tail cross section to engage against the angled sides.

The inward facing surface can be defined on a protruding area of the inner flange having a dimension, in the circumferential direction, that is less than a width of the inner flange in the circumferential direction.

The strut body can have an airfoil shaped cross section including opposing sides parallel to a direction of gas flow through the annular gas path.

In accordance with another aspect of the invention, a turbine assembly is provided in a turbine engine, the turbine assembly having an outer casing, an inner structural ring, and an annular gas path defined between outer and inner flow path walls for conducting a gas flow through the turbine assembly in an axial direction, and further comprising: a plurality of structural struts spaced apart in a circumferential direction, each strut including a strut body extending in a radial direction between and supporting the inner structural ring to the outer casing; a fairing surrounding each of the struts in an area extending between the outer and inner flow path walls; a first strut end at a radially outer end of the strut body and detachably attached to the outer casing with a first fastener structure engaging the outer casing, the first fastener structure including a plurality of bolts for retaining the first strut end to the outer casing; and a second strut end at a radially inner end of the strut body and detachably attached to the inner structural ring with a second fastener structure, the second fastener structure including a plurality of bolts engaged in the inner structural ring.

The first strut end may include an outer flange extending perpendicular to the radial direction and the bolts of the first fastener structure can pass through the outer flange and engage in holes in the outer casing.

The second strut end can includes an inner flange extending outward from the strut body and perpendicular to the radial direction of the strut, the inner flange can include a surface facing radially inward and engaging a surface of the inner ring structure that faces radially outward.

The bolts of the second fastener structure can pass through the inner flange and are engaged in holes in the inner structural ring.

The inner structural ring can include first and second ring portions that cooperate with each other to clamp the inner flange to the inner ring structure.

The bolts of the second fastener structure can pass through the first and second ring portions to retain the second strut end in engagement with the inner ring structure.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

FIG. 1 is a schematic illustration of an aero derivative industrial gas turbine engine that may incorporate aspects in accordance with the invention;

FIG. 3 is a cross-sectional view taken along line A-A in FIG. 2;

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 2:
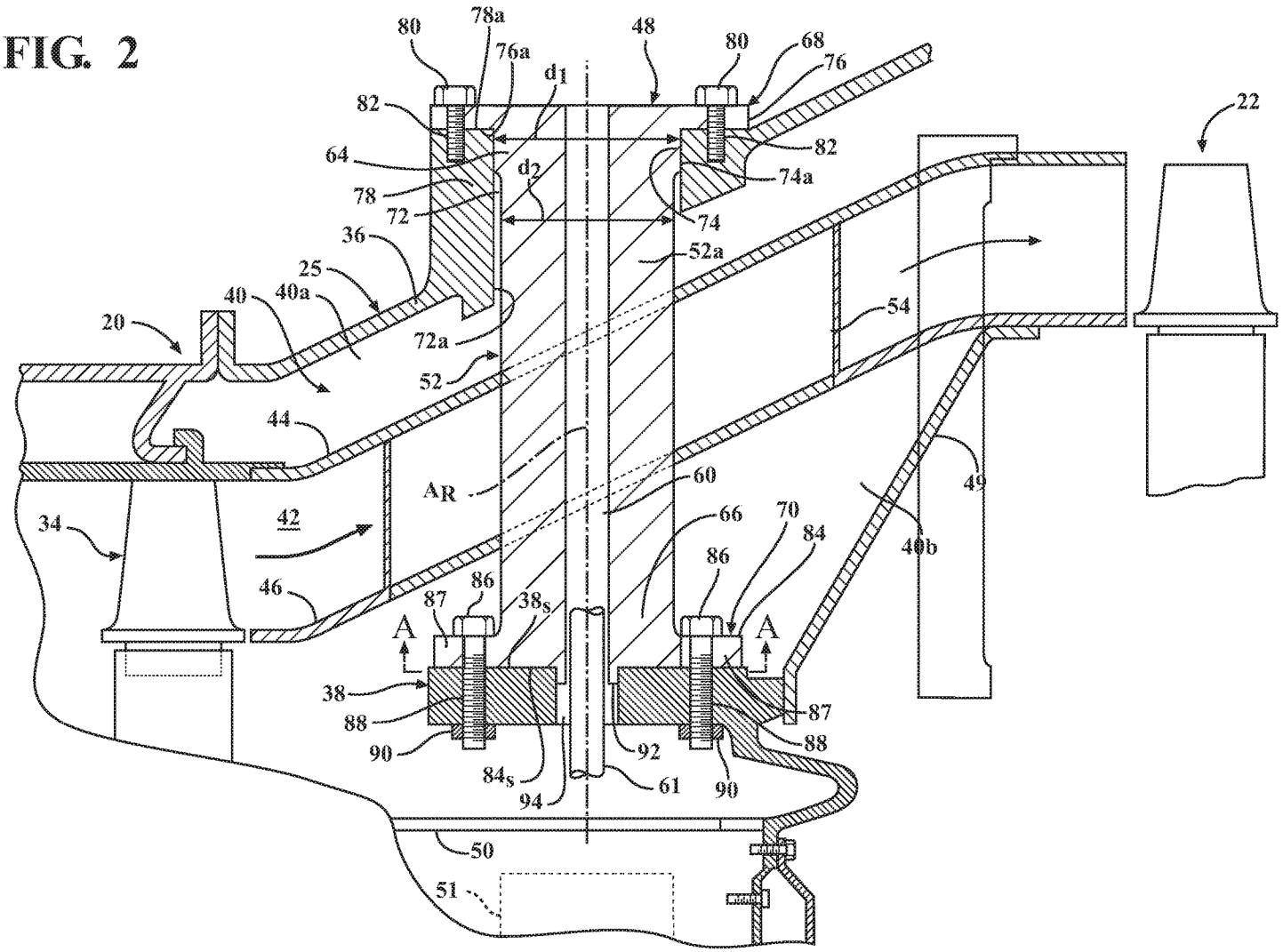
FIG. 2 is a cross sectional view through a turbine exhaust casing section of the engine illustrating aspects of the invention.

FIG. 1 schematically illustrates a gas turbine engine 10 that may incorporate the present invention. It should be noted that the particular engine depicted in FIG. 1 comprises an aero derivative industrial gas turbine engine; however, this invention is not limited to the particular engine described herein. The gas turbine engine 10 comprises a high pressure compressor 12, a low pressure compressor 14, a combustor 16, a turbine section 17 including a high pressure turbine 18, a low pressure turbine 20, and a power turbine 22, and an electric generator 24. An intermediate casing 21 extends between the low pressure turbine 20 and the power turbine 22, and comprises a turbine exhaust casing 25 (FIG. 2). The low pressure compressor 14 compresses ambient air through successive stages to generate low pressure air, and the high pressure compressor 12 compresses partially compressed air from the low pressure compressor exit through successive compressor stages to generate high pressure air. The high and low pressure compressors 12, 14 are collectively referred to herein as "compressor apparatus".

The combustor 16 combines a portion of the compressed air from the compressor apparatus with a fuel and ignites the mixture creating combustion products defining hot working gases. The working gases travel from the combustor 16 to the turbine section 17. Within each turbine 18, 20 and 22 in the turbine section 17 are rows of stationary vanes (not shown) and rotating blades (not shown). For each row of blades, a separate disc (not shown) is provided. The discs forming part of the high pressure turbine 18 are coupled to a first rotatable shaft 26 (see FIG. 1), which is coupled to the high pressure compressor 12 to drive the high pressure compressor 12. The discs forming part of the low pressure turbine 20 are coupled to a second rotatable shaft 28 (schematically shown in FIG. 1), which is coupled to the low pressure compressor 14 to drive the low pressure compressor 14. The second rotatable shaft 28 is positioned within and is co-axial with the first rotatable shaft 26, as depicted in FIG. 1. The discs forming part of the power turbine 22 are coupled to a third rotatable shaft 30 (see FIG. 1), which is coupled to the electric generator 24 to drive the electric generator 24. As the working gases expand through the turbines 18, 20, 22, the working gases cause the rows of rotatable blades within the turbines 18, 20, 22, and therefore the corresponding discs and first, second, and third shafts 26, 28, 30 to rotate. The structure formed by the turbine discs and shafts 26, 28, 30 are generally referred to as a turbine rotor.

FIG. 2 illustrates the turbine exhaust casing 25 located at the outlet or exhaust of a last stage of the low pressure turbine 20, including a last stage row of vanes (not shown) and a last stage row of blades 34. Turbine exhaust casing 25 includes an outer structural ring or casing 36 and an inner structural ring or casing 38, defining a turbine exhaust casing cavity 40 therebetween.

An annular exhaust gas path 42 is defined between an outer flow path wall 44 and an inner flow path wall 46. The gas path 42 conducts hot gases in an axial direction from the low pressure turbine 20 to the power turbine 22 and divides the exhaust casing cavity into an outer casing cavity or cavity portion 40*a* and an inner exhaust casing cavity or cavity portion 40*b*. The outer exhaust casing cavity 40*a* is generally defined between the outer ring 36 of the exhaust casing 25 and the outer flow path wall 44, and the inner casing cavity 40*b* is generally defined between the inner flow path wall 46 and a cone 49 extending between the inner ring 38 and a front or upstream end of the power turbine 22.

Figure 5:
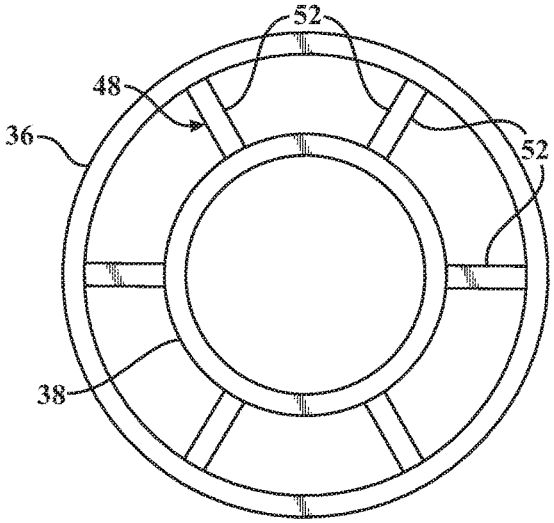
FIG. 5 is a diagrammatic cross-sectional view taken axially and showing a plurality of strut assemblies in the turbine exhaust casing.

Referring to FIGS. 2 and 5, a plurality of strut assemblies 48 are spaced circumferentially around the turbine exhaust casing 25, extending radially inward from the outer ring 36 to the inner ring 38 for supporting the inner ring 38. A bearing housing 50 is supported to a radially inner side of the inner ring 38 and is provided for enclosing a rear bearing, illustrated diagrammatically as 51, for supporting the turbine rotor. Each strut assembly 48 includes a structural strut 52, affixed to the outer and inner rings 36, 38, and a fairing 54 surrounding the strut 52 and extending between the outer and inner flow path walls 44, 46 for isolating and protecting the strut 52 from the hot gases passing through the gas path 42, see also FIG. 3.

It may be noted that although six struts 52 are illustrated herein (FIG. 5), within the scope of the present invention, other numbers of struts 52, may be provided. For example, eight struts 52, or any other number of struts, may be provided.

As seen in FIG. 3, each strut 52 includes a strut body 52*a* that is elongated in the axial direction of the engine, defining outer sidewalls 56, 58 that extend parallel to the axial direction of gas flow. The struts 52 are formed as generally solid structural members, i.e., resistant to bending, to provide substantial structural support for locating the inner ring 38 in the radial, axial and circumferential directions. In this regard, it may be noted that a substantially large pressure force may be present within the casing cavity 40, creating a "blow-off" load in the aft direction. Further, each strut 52 can be formed with a radially extending cavity 60 can provide a passage for an oil supply line 61, or other service lines.

Referring to FIG. 2, in accordance with an aspect of the invention, the struts 52 are detachably mounted, e.g., non-welded or non-integrally attached, to the outer ring 36 and inner ring 38. In the illustrated embodiment, the struts 52 are abutted against the outer and inner rings 36, 38, and are attached to the outer and inner rings 36, 38 by detachable fastener connections. In particular, the strut body 52*a* of each strut 52 extends in the radial direction between a radially outer first strut end 64 and a radially inner second strut end 66. The first strut end 64 is detachably attached to the outer casing 36 with a first fastener structure 68 engaging the outer casing 36, and the second strut end 66 is detachably attached to the inner ring 38 with a second fastener structure 70 engaging the inner ring 38.

In accordance with an aspect of the invention illustrated in FIG. 2, the outer casing 36 includes a strut aperture 72 defined by an aperture surface 72*a*. The first strut end 64 includes a boss 74 comprising an outer boss surface 74*a* engaged against the aperture surface 72*a*, and having a cross sectional shape corresponding to the cross sectional shape of the strut aperture 72. The strut body 52*a* defines a diametric dimension $d_2$ that is less than a diametric dimension $d_1$ of the outer boss surface 74*a* parallel to the diametric dimension $d_2$ of the strut body 52*a*, such that the strut body 52*a* is spaced from the aperture surface 72*a* at a location where the strut body 52*a* is radially aligned with or adjacent to the aperture surface 72*a*. A close fit is provided between the aperture surface 72*a* and the outer boss surface 74*a*, such that side loads, i.e. circumferential and/or axial loads, can be transferred directly from the strut 52 to the outer casing 36, and not be carried by fastener connections at the first fastener structure 68, as is described in greater detail below.

The first strut end 64 is formed with an outer flange 76 defining a portion of the first fastener structure 68 and extending perpendicular to the radial direction of the strut 52, as may be defined by a radial axis $A_R$ of the strut 52. The outer flange 76 extends over and is positioned in contact with a portion of the outer casing 36. For example, the outer casing 36 may be formed with a portal structure 78 that defines at least a portion of the strut aperture 72 and provides a planar outward facing surface 78*a* for cooperating with a planar inward facing surface 76*a* of the outer flange 76. The first fastener structure 68 can further include bolts 80 located around the periphery of the first strut end 64, passing through holes in the outer flange 76 and engaged in holes 82, e.g., threaded holes, in the outer casing 36. The positioning of the outer flange 76 on the cooperating surface 78*a* of the portal structure 78 can operate to locate the second end 66 of the strut 52 at a predetermined radially inner position. It may be understood that the bolts 80 could optionally comprise studs positioned in threaded holes 82 in the outer casing 36, and nuts engaged on the studs to retain the outer flange 46 in engagement on the portal structure 78 of the outer casing 36.

In accordance with a further aspect of the invention illustrated in FIG. 2, the second strut end 66 can include an inner flange 84 defining a portion of the second fastener structure 70 and extending outward from the strut body 52*a* and perpendicular to the radial direction, i.e., the radial axis $A_R$, of the strut 52. The inner flange 84 can include an inward facing planar surface $\mathbf{84}_S$ engaging an outward facing planar surface $\mathbf{38}_S$ of the inner ring structure 38. The second fastener structure 70 can further include bolts 86 located around the periphery of the second strut end 66, passing through holes 87 in the inner flange 84 and passing through holes 88 in the inner ring 38. The inner flange 84 can be retained in engagement with the inner ring 38 by nuts 90 engaged on the bolts 86, providing accurate positioning of the inner ring 38 and the associated bearing 51 to a predetermined radial position. It may be understood that the bolts 86 could optionally comprise studs positioned, for example, in threaded holes 88 in the inner ring 38, and nuts engaged on the studs to retain the inner ring 38 in engagement on the second strut end 66.

Referring to FIGS. 2 and 3, the second strut end 66 includes a spigot 92 protruding from the inward facing surface $\mathbf{84}_S$ and engaging within a recess 94 extending into the outward facing surface $\mathbf{38}_S$. The spigot 92 can be a circular or annular protrusion extending in a close fit within the recess 94. Positioning of the spigot 92 within the recess 94 provides a positive engagement of the second strut end 66 with the inner ring 38. That is, the spigot 92 can provide an alignment of the second strut end 66 relative to the inner ring 38 at a predetermined location with reference to directions perpendicular to the radial direction, and provides a radially extending engagement surface for transmitting forces in axial and circumferential directions between the strut 52 and the inner ring 38. Hence, the bolts 86 retaining the inner ring 38 to the strut 52 are not required to carry all of the loads transmitted between the strut 52 and the inner ring 38.

Figure 4:
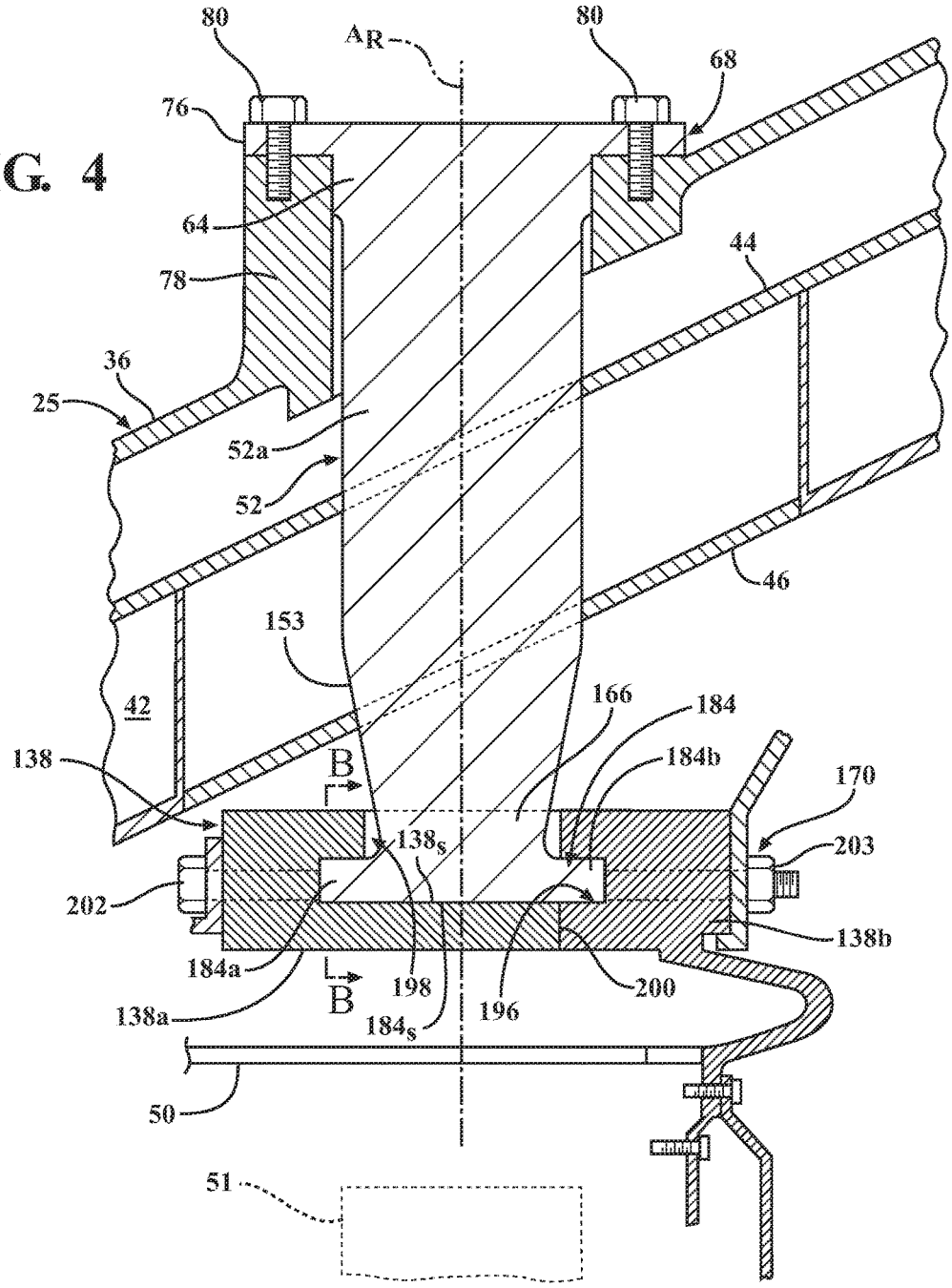
FIG. 4 is a cross sectional view through a turbine exhaust casing section of the engine illustrating further aspects of the invention.

In accordance with another aspect of the invention shown in FIG. 4, the second strut end 166 can comprise an alternative second fastener structure 170 for connecting the strut 52 to the inner ring 138. The strut 52 in the illustrated configuration can have an inwardly tapered portion 153 extending from a location adjacent to the gas path 42 to the second strut end 166. The second fastener structure 170 includes an inner lug structure or inner flange 184 extending outward from a minimum or reduced cross sectional portion of the strut body 52*a* and perpendicular to the radial direction, i.e., the radial axis $A_R$, of the strut 52. The inner flange 184 can include an inward facing planar surface $\mathbf{184}_S$ engaging an outward facing planar surface $\mathbf{138}_S$ of the inner ring 138.

The inner flange 184 is positioned in a T-shaped slot 196 formed in the inner ring 138, as viewed circumferentially at an axial cross section. The "T" is defined by a vertical leg parallel to the radial axis $A_R$ and a horizontal leg parallel to the outward facing surface $\mathbf{138}_S$ and extending in axial direction. The inner ring 138 comprises first and second ring portions 138*a*, 138*b* coupled together to sandwich the inner flange between the first and second ring portions and to define a portion of the second fastener structure 170 formed in the inner ring 138. In particular, the ring portions 138*a*, 138*b* have respective forward and aft portions of the horizontal leg of the T-shaped slot 196 formed in them to receive corresponding forward and aft portions 184*a*, 184*b* of the inner flange 184. The forward and aft portions 184*a*, 184*b* of the inner flange 184 and the second end 166 of the strut 52 form a T-shaped inner end corresponding to the T-shaped slot 196. The reduced cross sectional portion of the strut body 52*a* extends through a channel 198 defined at a radial outer end of the T-shaped slot 196, and a clearance may be provided between the strut body 52*a* and the edges of the channel 198 to accommodate a limited amount of axial movement of the strut body 52*a* relative to the edges of the channel 198 while radially retaining the second end 166 in engagement with the inner ring 138.

Figure 4A:
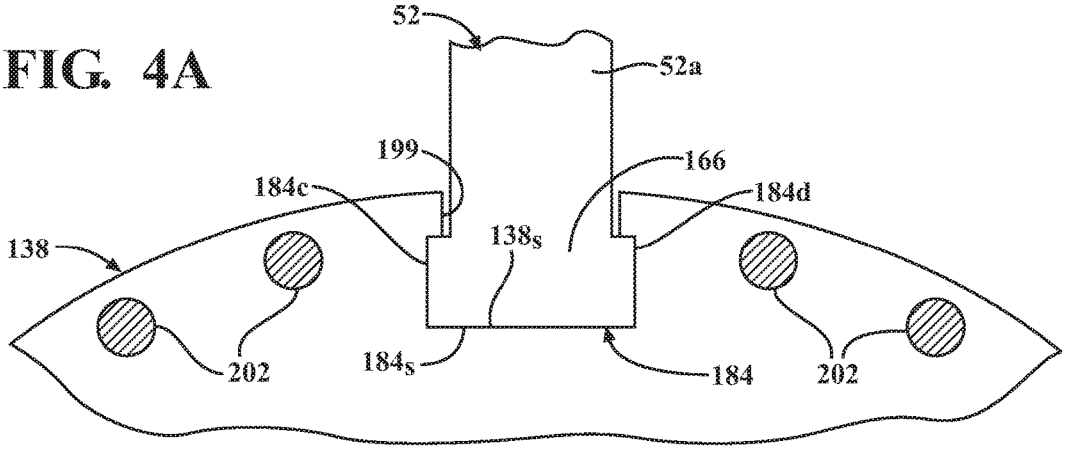
FIG. 4A is a cross-sectional view taken along line B-B in FIG. 4.

The first and second ring portions 138*a*, 138*b* are joined together at a joint 200 overlapping, in the axial direction, the inner flange 184 to enclose the inner flange 184. Referring additionally to FIG. 4A, the second ring portion 138*b* is retained in engagement with the first ring portion 138*a* by a plurality of circumferentially spaced fasteners that can comprise bolts 202 extending axially through the ring portions 138*a*, 138*b* to complete, with associated nuts 203, the second fastener structure 170. Additionally, the inner flange 184 can include circumferentially extending flange segments 184*c*, 184*d* that fit within corresponding axially extending slot segments of the slot 196 in a close fit to align the strut 52 with the inner ring 138. A clearance may be provided between the strut body 52*a* and the edges of a passage 199 at a radially outer end of the slot 196 to accommodate a limited amount of circumferential movement of the strut body 52*a* relative to the edges of the passage 199.

The circumferentially extending flange segments 184*c*, 184*d* define a T-shaped cross section, as viewed in the axial direction at a circumferential cross section. The T-shaped cross section formed by the circumferentially extending flange segments 184*c*, 184 may be referenced as a circumferential T-shaped cross section of the inner flange 184, and the previously described T-shaped cross section of the inner flange 184 formed by the forward and aft flange portions 184*a*, 184*b* may be referenced as an axial T-shaped cross section of the inner flange 184. It may be understood that the second end 166 of the strut 52 can be assembled to the first ring portion 138*a* by relative axial movement causing the forward flange portion 184*a* to engage within the slot 196, and subsequently engaging the second ring portion 138*b* over the aft flange portion 184*b* and into engagement with the first ring portion 138*a*.

Figure 4B:
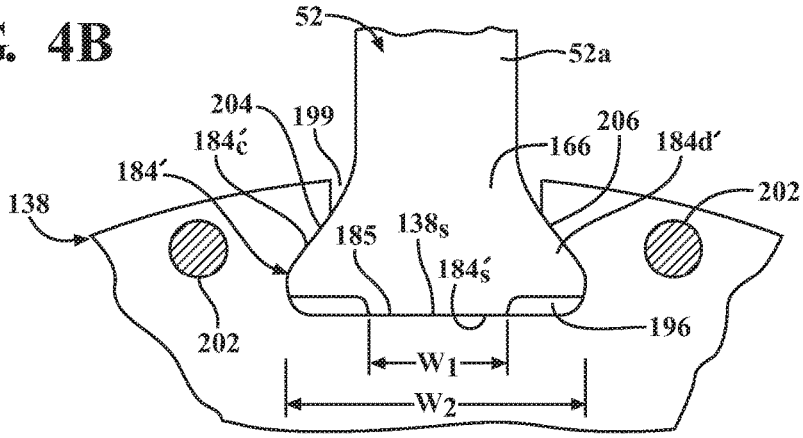
FIG. 4B is a cross-sectional view similar to FIG. 4A showing an alternative configuration in accordance with aspects of the invention.

Referring to FIG. 4B, an alternative construction of the configuration shown in FIG. 4A is illustrated. In accordance with aspects of the invention shown in FIG. 4B, the inner flange 184' is depicted having circumferentially extending flange segments 184*c*', 184*d*' that are formed with side portions 204, 206 that angle in toward circumferential sides of the strut 52 in the radial outwardly direction to define a dove tail shape for the inner flange 184'. It may be understood that the flange 184' can have an axial cross section that is generally similar to that shown in FIG. 4.

The T-shaped slot 196 is formed with similarly radially outward angled sides, angling circumferentially in toward each other, for cooperating in engagement with the side portions 204, 206. The dove tail configuration of the inner flange 184' provides a larger structural cross section for the flange and can provide a larger surface area for contact between the inner flange 184' and the T-shaped slot 196.

FIG. 4B additionally illustrates an alternative configuration for the inward facing surface of the inner flange 184', as depicted by inward facing surface $\mathbf{184}_S$'. In particular, the inward facing surface $\mathbf{184}_S$' is defined on a radially protruding area 185 of the inner flange 184 having a width dimension $W_1$, in the circumferential direction, that is less than a maximum width dimension $W_2$ of the inner flange 184' in the circumferential direction. The inward facing surface $\mathbf{184}_S$' provides a radial reference surface on the strut 52 for engaging the outward facing surface $\mathbf{138}_S$ and for locating the inner ring 138 in the radial direction, while reducing the contact area between the second strut end 166 and the inner ring 138. The reduced portion of the contact area can facilitate assembly of the strut 52 to the inner ring 138 and permit the dove tail flange segments 184*c*', 184*d*' to align in their engagement with the adjacent cooperating slot surfaces with minimal or decreased interference from the outward and inward facing surfaces $\mathbf{138}_S$, $\mathbf{184}_S$'. It should be understood that assembly of the configuration described for FIG. 4B can be performed in the same manner as described with reference to the configuration of FIGS. 4 and 4A.

It may also be understood that, although the configuration of the strut 52 depicted in FIG. 4 includes a tapered portion 153, other configurations of the strut can be provided with the second fastener structure 170. For example, the second fastener structure 170 may be provided with a straight strut configuration, such as is shown in FIG. 2.

The described configuration provides removable or detachable struts 52 that can be easily assembled to and removed from the turbine exhaust casing 25. As noted above, the struts 52 are configured as rigid structural members that are resistant to movement under loads, such as high blow-off loads within the casing 25, without additional frame or support bracing in order to provide a stationary, rigid support for the rear bearing 51 of the turbine. Further, the outer and inner connections between the struts 52 and the outer case 36 and inner ring 38 (138) are configured to accurately align the inner ring 38 (138) to a predetermined axial and radial location, and thereby provide an accurate positioning of the bearing 51 during assembly. The end structure of the struts 52, including for example the radially outer boss 74 and the radially inner spigot 92, in addition to providing the described alignment, can take shear loading that would otherwise go into the bolts associated with the first and second fastener structures 68, 70.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A turbine assembly in a turbine engine, the turbine assembly having an outer casing, an inner structural ring, and an annular gas path defined between outer and inner flow path walls for conducting a gas flow through the turbine assembly in an axial direction, and further comprising:

a plurality of structural struts spaced apart in a circumferential direction, each strut including a strut body extending in a radial direction between and supporting the inner structural ring to the outer casing;

a fairing surrounding each of the struts in an area extending between the outer and inner flow path walls;

a first strut end at a radially outer end of the strut body and detachably attached to the outer casing with a first fastener structure engaging the outer casing;

a second strut end at a radially inner end of the strut body and detachably attached to the inner structural ring with a second fastener structure engaging the inner structural ring;

wherein the second strut end includes an inner flange extending outward from the strut body and perpendicular to the radial direction of the strut, the inner flange including a planar surface facing radially inward and engaging a planar surface of the inner ring structure that faces radially outward;

wherein the inner flange is positioned in a T-shaped slot formed in the inner structural ring;

wherein the T-shaped slot includes radially outward extending, angled sides that angle towards sides of the strut body and the inner flange has a dove tail cross section to engage against the inner structural ring.

2. The turbine assembly of claim 1, wherein the outer casing includes a strut aperture defined by an aperture surface and the first strut end includes a boss comprising an outer boss surface engaged against the aperture surface, and the first strut end further includes an outer flange extending perpendicular to the radial direction and extending over and positioned in contact with a portion of the outer casing.

3. The turbine assembly of claim 2, wherein the first fastener structure includes bolts that pass through the outer flange and are engaged in holes in the outer casing.

4. The turbine assembly of claim 2, wherein the strut body defines a diametric dimension that is less than a diametric dimension of the outer boss surface parallel to the diametric dimension of the strut body, such that the strut body is spaced from the aperture surface at a location where the strut body is radially adjacent to the aperture surface.

5. The turbine assembly of claim 1, wherein the second fastener structure includes bolts passing through the inner flange and engaged in holes in the inner structural ring.

6. The turbine assembly of claim 1, including a spigot protruding from the inward facing planar surface and engaging within a recess in the outward facing planar surface to locate the second strut end at a predetermined location with reference to directions perpendicular to the radial direction.

7. The turbine assembly of claim 1, wherein the inner structural ring comprises first and second ring portions coupled together to sandwich the inner flange between the first and second ring portions.

8. The turbine assembly of claim 7, wherein the first and second ring portions are coupled at a joint overlapping the inner flange.

9. The turbine assembly of claim 7, wherein the second fastener structure comprises fasteners extending through and retaining the first and second ring portions in engagement with each other.

10. The turbine assembly of claim 1, wherein an inward facing surface is defined on a protruding area of the inner flange having a dimension, in the circumferential direction, that is less than a width of the inner flange in the circumferential direction.

11. The turbine assembly of claim 1, wherein the strut body has an airfoil shaped cross section including opposing sides parallel to a direction of gas flow through the annular gas path.

12. A turbine assembly in a turbine engine, the turbine assembly having an outer casing, an inner structural ring, and an annular gas path defined between outer and inner flow path walls for conducting a gas flow through the turbine assembly in an axial direction, and further comprising:

a plurality of structural struts spaced apart in a circumferential direction, each strut including a strut body extending in a radial direction between and supporting the inner structural ring to the outer casing;

a fairing surrounding each of the struts in an area extending between the outer and inner flow path walls;

a first strut end at a radially outer end of the strut body and detachably attached to the outer casing with a first fastener structure engaging the outer casing;

a second strut end at a radially inner end of the strut body and detachably attached to the inner structural ring with a second fastener structure engaging the inner structural ring wherein the second strut end has an inner flange positioned in a T-shaped slot formed in the inner structural ring, wherein the T-shaped slot includes radially outward extending, angled sides that angle towards sides of the strut body and the inner flange has a dove tail cross section to engage against the inner structural ring.

13. The turbine assembly of claim 12, wherein an inward facing surface is defined on a protruding area of the inner flange having a dimension, in the circumferential direction, that is less than a width of the inner flange in the circumferential direction.

* * * * *